US008449302B1

(12) United States Patent
Carahan

(10) Patent No.: US 8,449,302 B1
(45) Date of Patent: May 28, 2013

(54) GAME PIECE WITH A SELECTIVELY VIEWABLE HIDDEN IMAGE

(75) Inventor: Paul Christian Carahan, Norcross, GA (US)

(73) Assignee: World Touch Gaming, Inc., Cumming, GA (US)

( * ) Notice: Subject to any disclaimer, the term of this patent is extended or adjusted under 35 U.S.C. 154(b) by 82 days.

(21) Appl. No.: 13/159,062

(22) Filed: Jun. 13, 2011

Related U.S. Application Data

(60) Provisional application No. 61/354,649, filed on Jun. 14, 2010.

(51) Int. Cl.
*A63F 1/00* (2006.01)
*A63F 3/06* (2006.01)

(52) U.S. Cl.
USPC ..... 434/331; 273/293; 273/295; 273/138.1

(58) Field of Classification Search
USPC ..... 434/331; 273/293, 295, 138.1, 139
See application file for complete search history.

(56) References Cited

U.S. PATENT DOCUMENTS 2,840,073 A * 6/1958 Zeltzer et al. ..... 351/203
3,081,088 A * 3/1963 Kast ..... 273/240
3,281,960 A * 11/1966 Gross ..... 434/331
5,314,197 A * 5/1994 Hersch ..... 273/430
5,984,367 A 11/1999 Barnhart et al.
6,296,900 B1 10/2001 Barnhart et al.
6,406,062 B1 6/2002 Brooks et al.
6,629,888 B1 10/2003 Barnhart
6,833,829 B2 12/2004 Brooks et al.
7,747,472 B2 6/2010 Barnhart
2002/0153661 A1* 10/2002 Brooks et al. ..... 273/288
2005/0094811 A1* 5/2005 Mentz ..... 380/201
2006/0180673 A1* 8/2006 Finnerty et al. ..... 235/491
2010/0317431 A1* 12/2010 Kuan ..... 463/30

* cited by examiner

*Primary Examiner* — Benjamin Layno

(74) *Attorney, Agent, or Firm* — Baker Donelson Bearman Caldwell & Berkowitz PC

(57) ABSTRACT

A game piece with a hidden image that is visible through a decoder filter, with a first visible layer having an image gradient mapped to a first electromagnetic wavelength range and a second visible layer with a disguising mask and the image gradient mapped to a second electromagnetic wavelength range, the electromagnetic wavelength ranges selected based on a color hue for the decoder filter and the disguising mask having an electromagnetic wavelength within the second electromagnetic wavelength range. A method of making a game piece with a hidden image that is visible upon viewing through a decoder filter is disclosed.

18 Claims, 7 Drawing Sheets

GAME PIECE WITH A SELECTIVELY VIEWABLE HIDDEN IMAGE

TECHNICAL FIELD

The present invention relates to hidden images contained on game pieces. More particularly, the present invention relates to a game piece having a hidden image presented on a display device for selective viewing with a decoder.

BACKGROUND OF THE INVENTION

Hidden image game pieces provide a substrate which carries a hidden image that is visible by application of a transformative event. The hidden image typically is a text but may be a graphic image, which is applied to a canvas or substrate. A disguising mask is also carried on the canvas. The hidden image becomes visible often by viewing through a decoder film or sheet but other techniques exist for altering the game piece in order to make the hidden image appear visibly.

Typical hidden image game piece applications involve images printed on a paper or other sheet that carries the hidden image. The substrate is often used for games but may be used for other purposes, such as a message revealing retail discounts. Generally, the widest use of hidden image technology is for use in games for winning prizes or for participating in a prize winning event.

Hidden image technology can be used with display devices other than printed sheets or substrates. For example, an electronic image can be created of a game piece including a hidden image. An electronic canvas carrying the hidden image can be selectively displayed on video devices including screens of mobile computer devices, mobile telephones, personal data assistants, display screens of computer devices, as well as displayed in association with video displays of television. In such display devices. the hidden image is viewable by the user positioning a decoder viewer, for example, a decoder filter in front of the display screen in order to expose the displayed game piece to an additive light source provided by the filter.

While hidden image technology has been used in video display devices, there are drawbacks to the use. The hidden image needs to be prepared in such a way that it is effectively in the background so as to have a reduced visual presence or appearance to the viewer. The viewer's attention should be directed or lead to a foreground image or predominant disguising mask carried on the game piece. The observer's attention, thus, is directed to the disguising mask, and it is not until the decoding viewer is used that the observer then readily detects the hidden image carried on the game piece. While game pieces with text as a hidden image have transferred to video displays, the use of graphic images, for example, photographs of animals, persons, plants, landscapes, and the like have less readily transferred successfully to video presentation. By this, it is meant that observers, in the absence of the decoding viewer, are able to detect and determine at least portions of the hidden image.

Accordingly, there is a need for a game piece having a hidden image presented on a display device for selective viewing with a decoder. It is to such that the present invention is directed.

BRIEF SUMMARY OF THE INVENTION

The present invention meets the need in the art by providing a game piece with a hidden image that is visible upon selective viewing of the game piece through a decoder filter.

The game piece comprises (a) a first visible layer and (b) a second visible layer. The first visible layer comprises an image that is gradient mapped to a first electromagnetic wavelength range. The first electromagnetic wavelength range selected based on a color hue for a decoder filter and the first electromagnetic wavelength range having a first starting electromagnetic wavelength and a first ending electromagnetic wavelength, in which the first ending electromagnetic wavelength is different than the first starting electromagnetic wavelength. The second visible layer comprises a disguising mask and the image that is gradient mapped to a second electromagnetic wavelength range different from the first electromagnetic wavelength range. The second electromagnetic wavelength range selected based on the color hue for the decoder filter and the second electromagnetic wavelength range having a second starting electromagnetic wavelength and a second ending electromagnetic wavelength, in which the second ending electromagnetic wavelength is different than the second starting electromagnetic wavelength. The disguising mask having an electromagnetic wavelength within the second electromagnetic wavelength range. The image on the game piece is visible upon viewing the game piece through the decoder filter.

In another aspect, the present invention provides a method of making a game piece with a hidden image that is visible upon viewing the game piece through a decoder filter, comprising the steps of:

(a) gradient mapping an image to a first electromagnetic wavelength range, the first electromagnetic wavelength range
- selected based on a color hue for a decoder filter and
- having a first starting electromagnetic wavelength and a first ending electromagnetic wavelength,
- the first ending electromagnetic wavelength different than the first starting electromagnetic wavelength to form a first visible layer;

(b) gradient mapping the image to a second electromagnetic wavelength range different from the first electromagnetic wavelength range, the second electromagnetic wavelength range
- selected based on the color hue for the decoder filter and
- having a second starting electromagnetic wavelength and a second ending electromagnetic wavelength,
- the second ending electromagnetic wavelength different than the second starting electromagnetic wavelength to form a second visible layer; and (c) attaching a disguising mask to the second visible layer, the disguising mask having an electromagnetic wavelength within the second electromagnetic wavelength range, to form a composite two-layer game piece in which the image is visible upon viewing the game piece through the decoder filter.

Objects, advantages, and features of the present invention will be apparent upon a reading of the detailed description together with observing the drawings and reading the appended claims.

DETAILED DESCRIPTION

Figure 1:
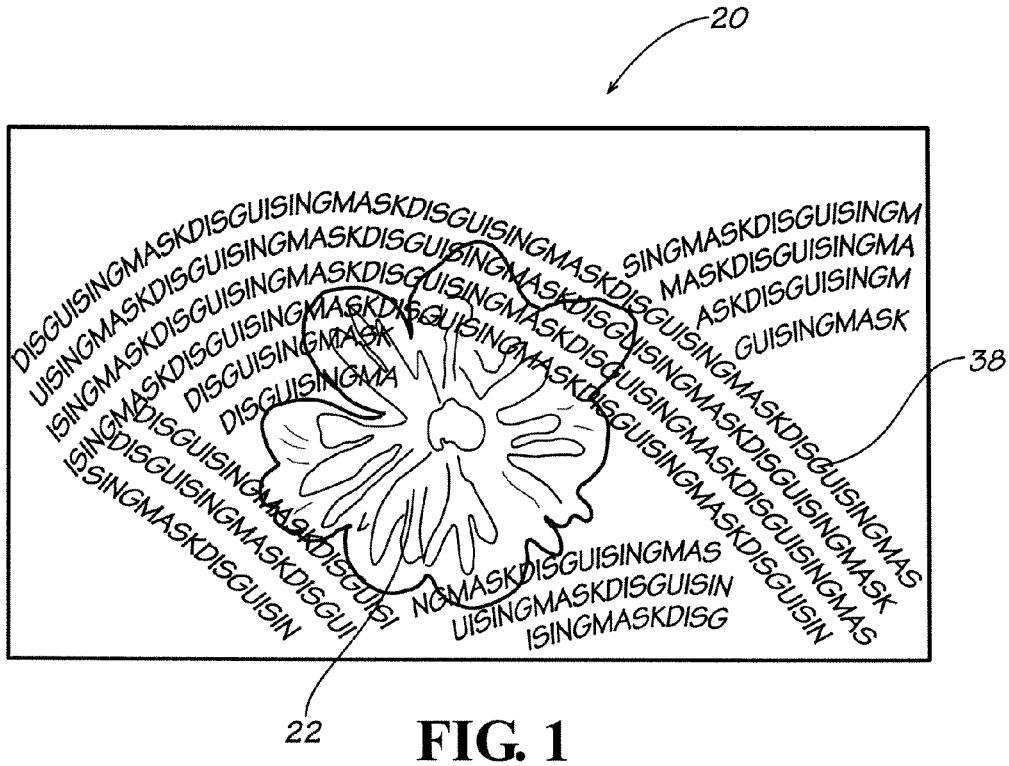
FIG. 1 illustrates a game piece having a hidden image in accordance with the present invention.

With reference to the drawings, in which like elements have like identifiers, FIG. 1 illustrates in cut-away view an embodiment of a game piece 20 having an image generally hidden in the game piece but viewable through a decoder filter 24 (see FIG. 3) that has a selected color hue, in accordance with the present invention. The illustrated embodiment depicts the game piece 20 with an electronic canvas 30 that holds a first layer 32 and a second layer 34. The first layer 32 includes a first hidden image 36. The first hidden image 36 is created to have a first wavelength characteristic for selective viewing in accordance with the present invention. The first wavelength characteristic relates to the image formed as the first hidden image 36. In the illustrated embodiment, the first wavelength characteristic is the hidden image gradient mapped to a first wavelength range.

The second layer includes a disguising mask 38 and a second hidden image 40. The second hidden image 40 overlaps and aligns with the first hidden image 36. The second hidden image 40 is created to have a second wavelength characteristic for selective viewing of the first hidden image 36 as discussed below. The second wavelength characteristic relates to the image formed as the second hidden image 40. In the illustrated embodiment, the second wavelength characteristic is the hidden image gradient mapped to a second wavelength range. The second wavelength range differs from the first wavelength range. The image 22 hidden in the game piece 20 is observable by viewing the game piece through the decoder filter 24.

Figure 2:
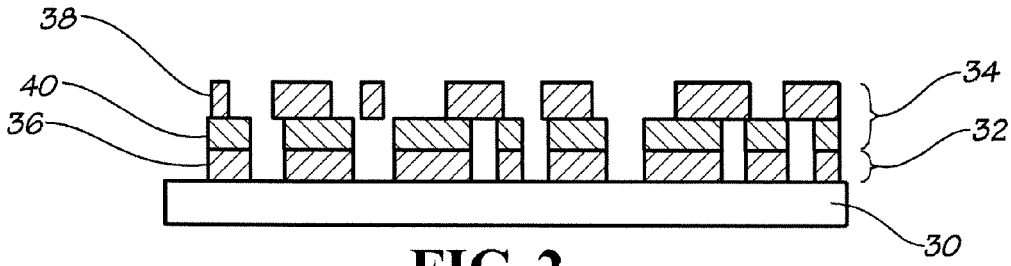
FIG. 2 illustrates in detailed side view a cross-section of the game piece illustrated in FIG. 1.

FIG. 2 illustrates in detailed side view an exaggerated cross-section of the game piece 20 illustrated in FIG. 1. The canvas 30 holds the first and second layers 32, 34, each with its respective hidden image 36, 40. The second layer 34 further includes the disguising mask 38. The disguising mask 38 further is created with a wavelength within the second wavelength characteristic.

Figure 3:
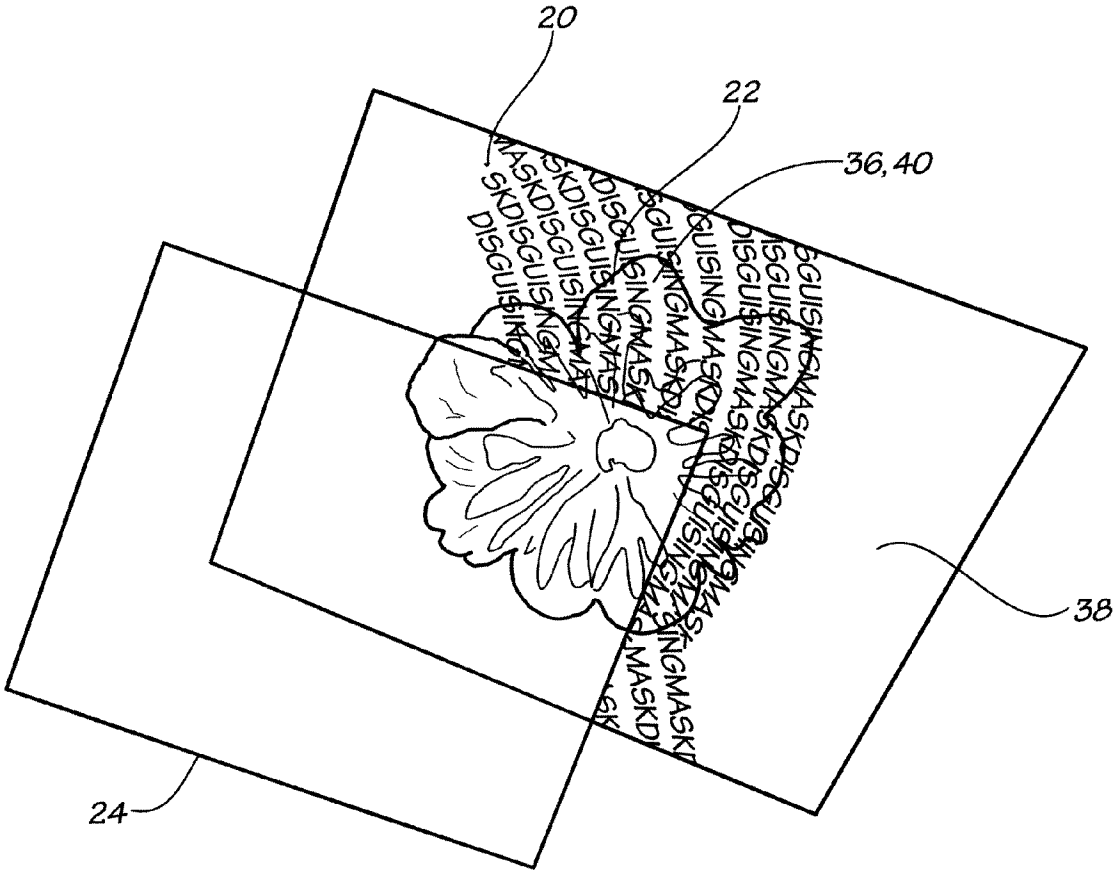
FIG. 3 illustrates the game piece illustrated in FIG. 1 with a decoder filter to view the hidden image in accordance with the present invention.

FIG. 3 illustrates in perspective view the game piece 20 containing the image 22 hidden from view with a portion of the image visible by viewing the game piece through the decoder filter 24. The color hue of the decoder filter 24 blocks a portion of the transmission of light wavelength from both the first and the second wavelength characteristic, causing shades of color to neutralize so that the hidden image 36 is visible and viewable through the decoder filter.

Figure 4:
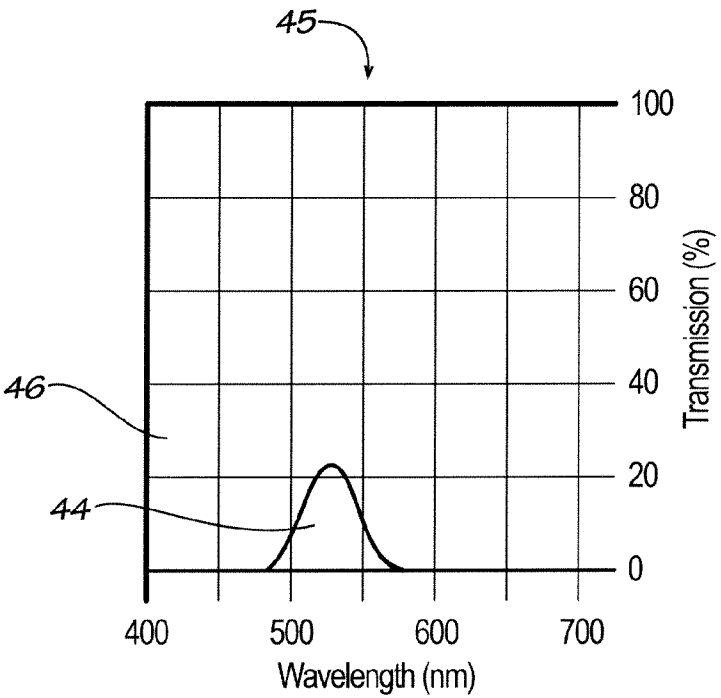
FIG. 4 illustrates a spectral power distribution (SPD) graph for a color hue of a decoder filter graphing the electromagnetic wavelength against percent light transmission.

FIG. 4 illustrates a spectral power distribution (SPD) graph 45 for a selected color hue for the decoder filter 24, when tungsten light of 3200K is shown through the decoder filter onto a white surface. The graph 45 plots wavelength in nanometers versus percent light transmission. The SPD graph shows the percentage of light at each wavelength across the visible portion of the electromagnetic spectrum that is passed when light is shone through a filter having the particular color hue. The plot of the data allows readily identifying which constituent wavelengths of the source light will be transmitted, and which will be reduced or blocked from transmission. Typically, the plot of these light or wavelength properties defines a bell shaped curve. Light at a wavelength within the curve (generally 44) transmits through the decoder filter 24 while light at a wavelength outside the curve (generally 46) is reduced or blocked from transmission through the decoder filter 24.

Figure 5:
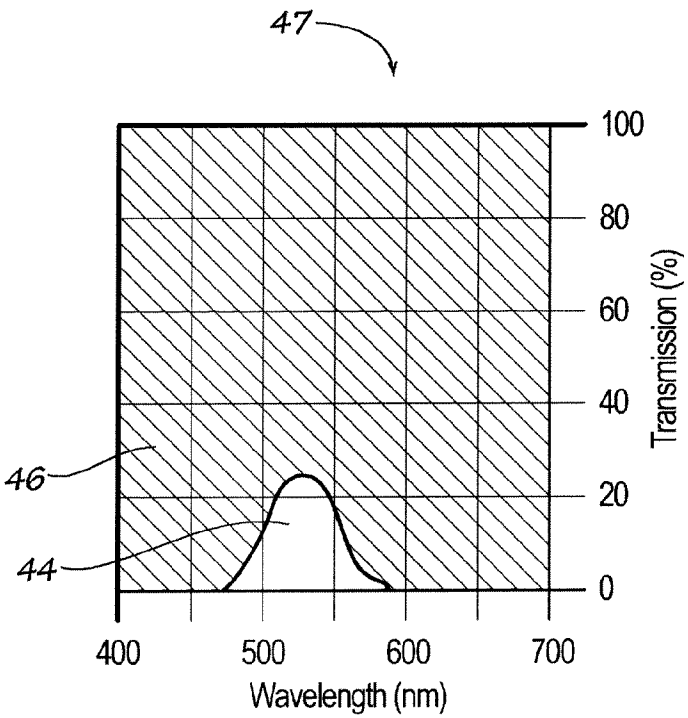
FIG. 5 illustrates a filtered output graph for the spectral power distribution (SPD) graph shown in FIG. 4 based on the selected color hue.

FIG. 5 illustrates a filter output graph 47 for the spectral power distribution (SPD) graph 45 shown in FIG. 4 for a selected color hue for the decoder filter 24. The light wavelengths within 44 the interior portion of the depicted curve results in a relatively lighter filter value. The light wavelengths outside of the depicted curve (generally 46) results in a relatively darker filter value (shown in cross-hatch).

A color hue for the decoder filter 24 is selected using spectral power distribution (SPD) graphs, as discussed above. Based on the selected color hue, the first wavelength characteristic, and thus the first wavelength range, for the first hidden image 36 is selected. Similarly, the second wavelength characteristic, and thus the second wavelength range, for the second hidden image 40 is selected. This is accomplished using a graph that illustrates the visible light spectrum as a continuum of 0° to 270° for the spectral power distribution (SPD) graph of the selected color hue of the decoder filter 24. It is noted light spectrum of 270-360 degrees is classified as "extra spectral" and thus the SPD graph does not plot a curve within the "magenta" range. In circumstances, having a strong violet decoder filter with transmission percentages within the low violet ranges (400 s nm) makes magenta/fuchsia (270 degrees+) possible candidates as color selections for one of the gradient map wavelength ranges. Similarly, strong red decoder filters with transmission percentages within 650 nm+ ranges.

Figure 6:
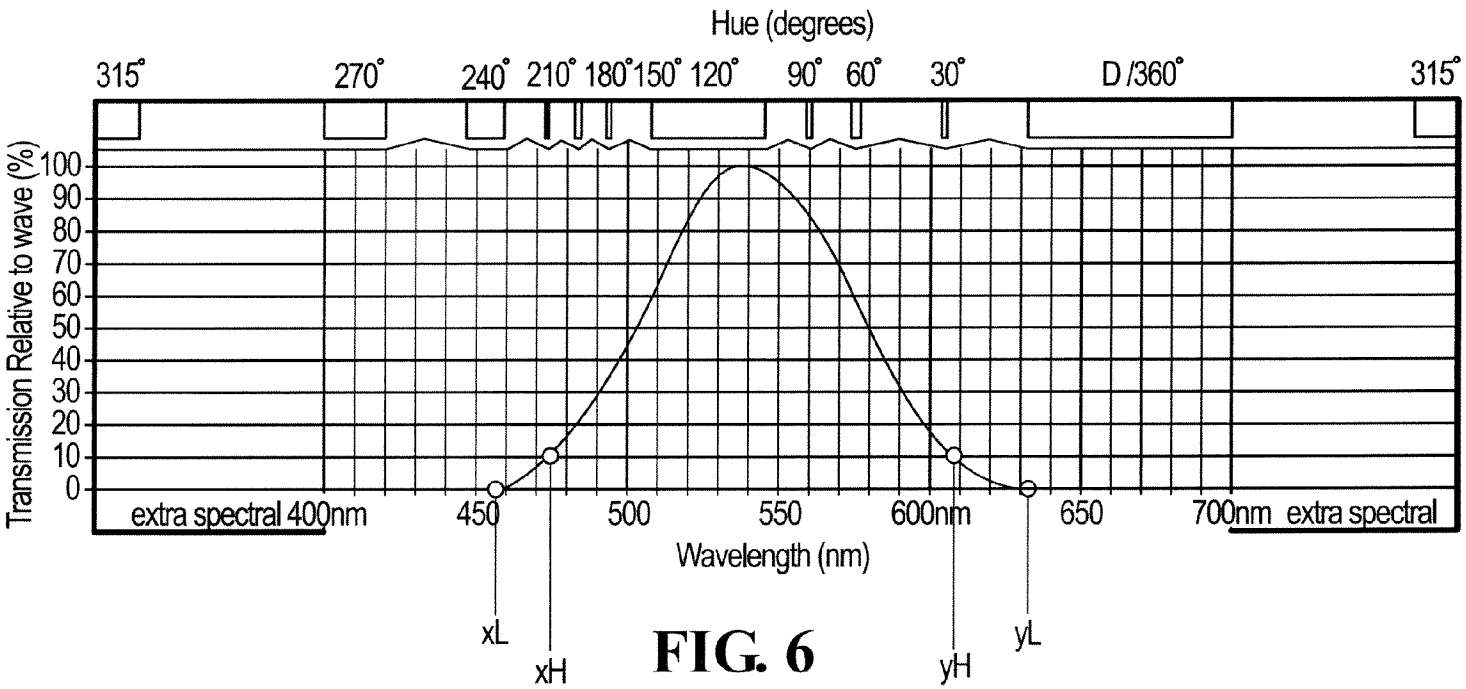
FIG. 6 illustrates a spectral power distribution (SPD) graph of the selected color hue of the decoder filter overlaid on the visible light spectrum continuum.

With reference to FIG. 6, the spectral power distribution (SPD) graph of the selected color hue of the decoder filter 24 is overlaid on the visible light spectrum continuum. The first wavelength range (xL-xH) for the first layer 32 and the second wavelength range (yH-yL) for the second layer 34 are selected, where x refers to the range for the first layer 32 and y refers to the range for the second layer 34, and L refers to the wavelength at which the light transmission is low and H refers to a selected wavelength at which the light transmission is high (relative to zero transmission). The selected wavelengths thus define two ranges of high contrast (dark to light, for one of the layers 32, 34, and light to dark, for the other of the layers 34, 32). The ranges each have a low wavelength value and a high wavelength value. The ranges are selected so that there is a high contrast between the lower wavelength value and the high wavelength value in the filtered light when viewed though the decoder filter 24. Thus, the first layer 32 will be displayed in colors in the range from about 457 nm to about 475 nm and the second layer 34 will be displayed in colors in the range from about 609 nm to about 633 nm. When these colors in the first and second layers are viewed through the decoder filter 24, the differences in hue colors neutralize so that the hidden image 36 is visible and viewable through the decoder filter, as discussed above.

Figure 7:
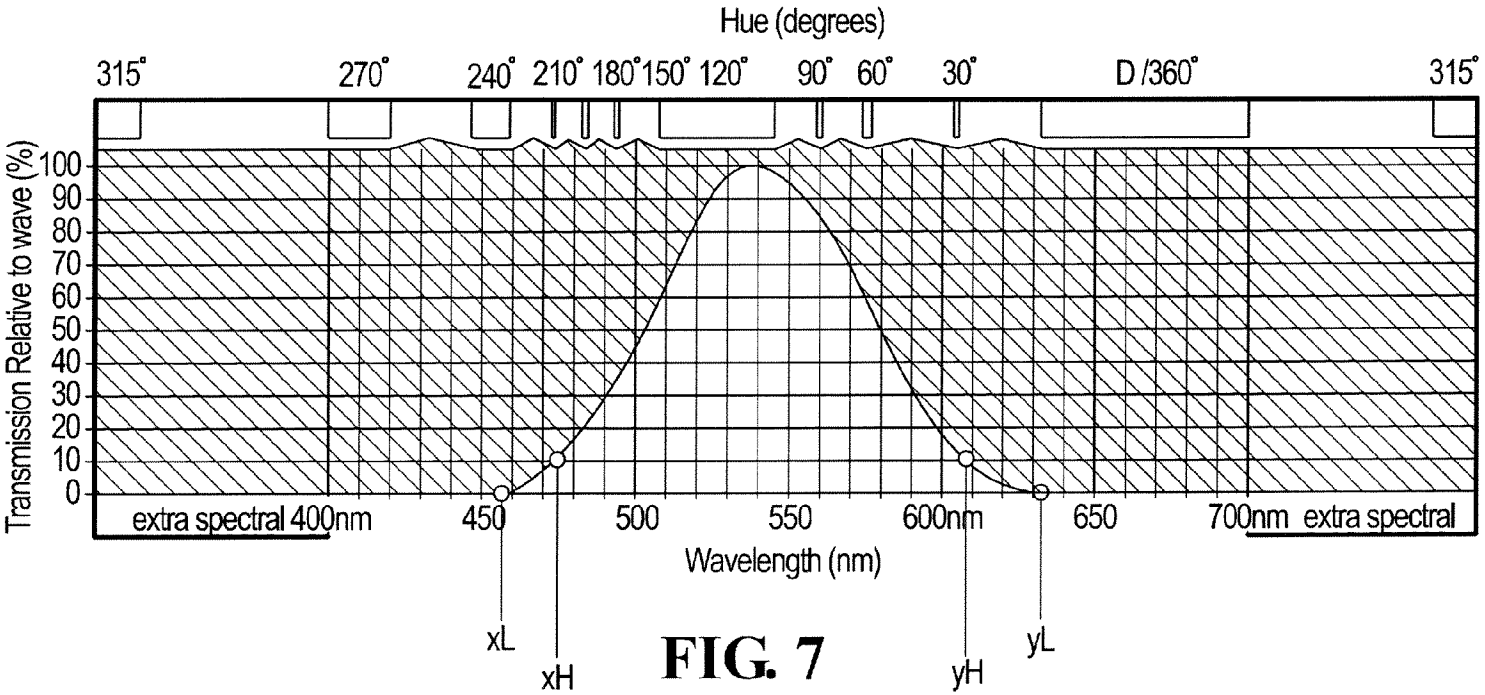
FIG. 7 illustrates a normalized spectral power distribution (SPD) graph of the selected color hue of the decoder filter overlaid on the visible light spectrum continuum.

For purposes of illustration and clarity, FIG. 7 illustrates the spectral power distribution (SPD) graph of the selected color hue of the decoder filter 24 overlaid on the visible light spectrum continuum normalized to two contrasting colors (dark shown in cross-hatch and light).

It is to be appreciated that in the graphs in FIGS. 6 and 7 displaying transmission relative to wavelength value, the xL and yL are the intersection of the curve at 0% transmission. The other range values xH and yH have higher transmission percentages, generally between about 5% to about 20%. Generally, the higher the percentage transmission, the greater the contrast of the resulting filtered image. However, moving higher in percentage transmission results in a greater wavelength difference between L and H. Generally, a wavelength difference between L and H should not be greater than approximately 60° of the visible light spectrum continuum of the selected color hue of the decoder filter 24. In relationship to L and H, the wavelength difference should be the lowest possible with H having highest transmission relative to wave percentage. Therefore, generally, the color filter (decoder filter 24) should have a narrow and tall SPD curve characteristic to ensure optimal plotting of L and H for both x and y.

Figure 8:
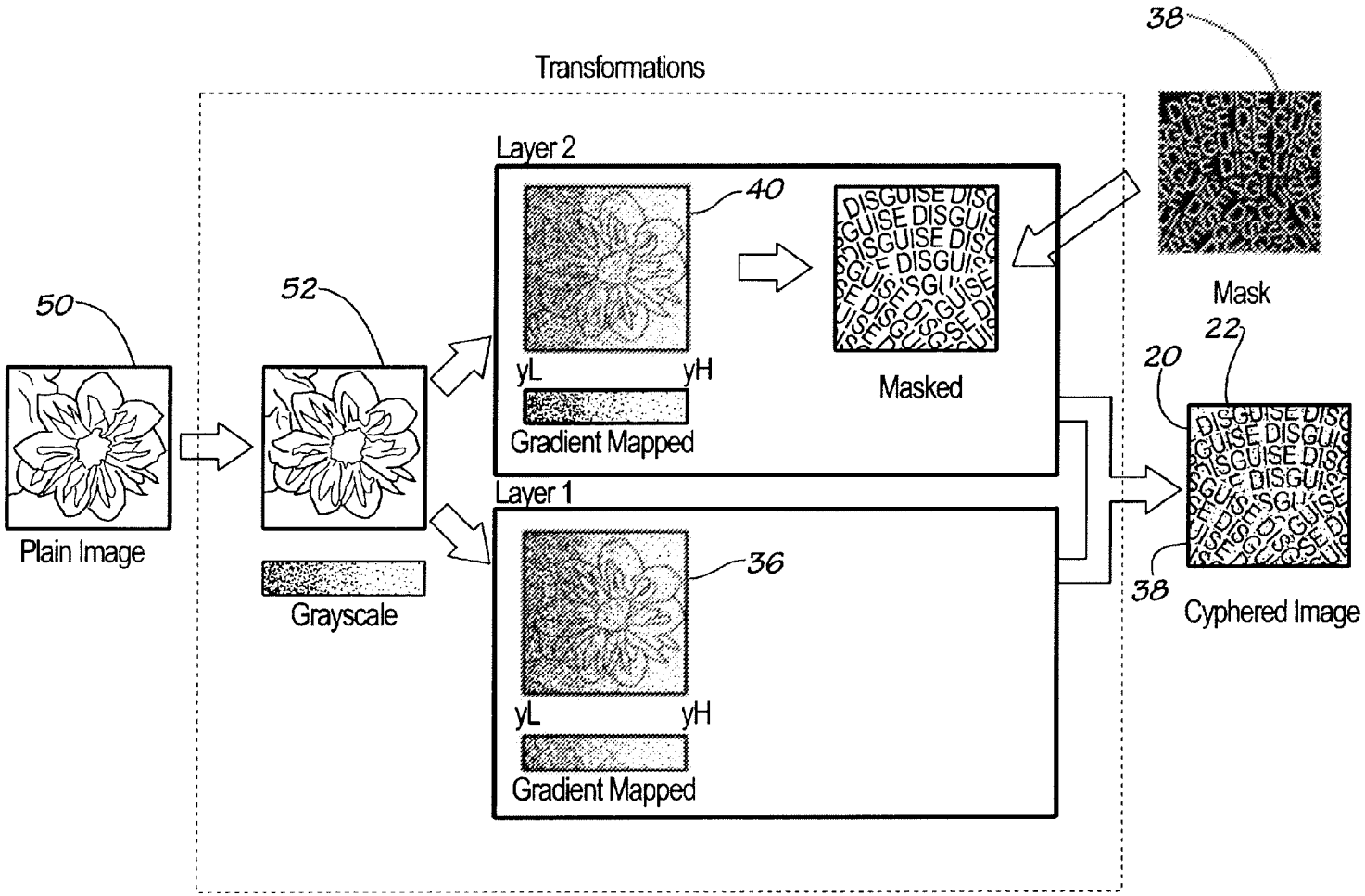
FIG. 8 illustrates a process for forming a two-layer game piece having a hidden image viewable with the decoder filter.

FIG. 8 illustrates a process for an image to be hidden in the game piece 20 in accordance with the present invention, which game piece is particularly suited for display on low resolution video displays and monitors, by way of example and not of limitation such as televisions and computer display monitors devices, mobile computer devices, personal data assistant devices, and other small screen, low resolution devices (in contrast to high resolution ink printing or ink printed devices). An image 50 is selected and a grayscale image 52 is formed. The grayscale image 52 is used for the hidden images 36, 40 in the first and second layers 32, 34. The first hidden image 36 in the first layer 32 has the first wavelength characteristic and is formed by gradient mapping the grayscale image 52 with the first wavelength range yL to yH. The second hidden image 40 in the second layer 34 has the second wavelength characteristic and is formed by gradient mapping the grayscale image 52 with the second wavelength range xL to xH. The disguising mask 38 is attached to the gradient mapped second hidden image. The first layer 32 and the second layer 34 are sandwiched to form the game piece 20 that includes the ciphered or hidden image.

Figure 9:
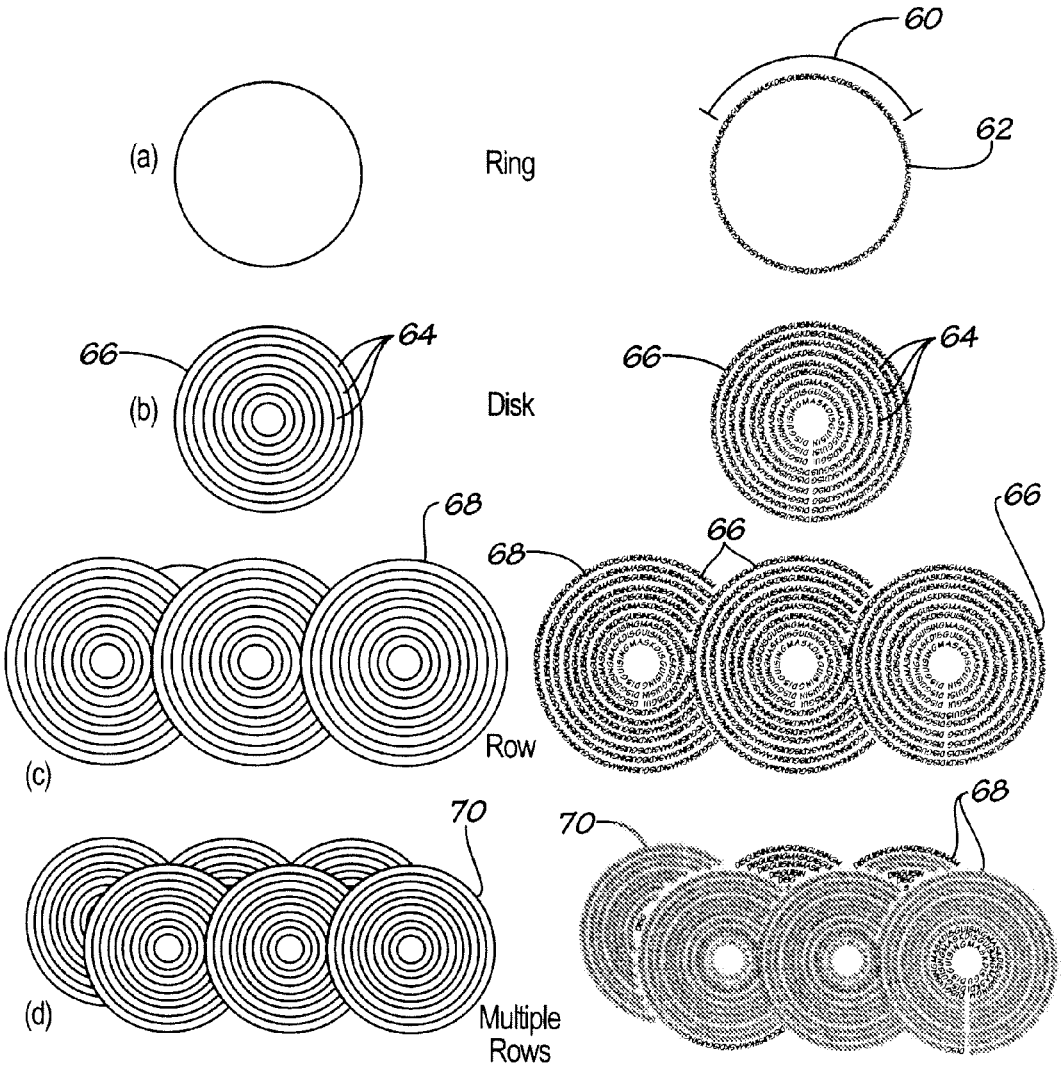
FIG. 9 illustrates a disguising mask for use with the game piece shown in FIG. 1.

FIG. 9 illustrates the disguising mask 38 made in the illustrated embodiment as an arucate fan pattern 60 of text 62 arranged in a plurality of concentric rings 64 that are spaced apart to define a disk 66. A plurality of disks 66 are overlapped to define a row 68 of disks. A plurality of rows are spaced-apart to define a field 70. A portion of the field 70 overlies the hidden image 40 in the second layer 36, as discussed above. The pattern can be a different shape than arcuate, for example, line segments orientated at angles relative to each other. Arcuate or sloping curved lines of text facilitate the observer reading the disguising text. Thus, the game piece 20 leads the observer to focus attention on the predominate image of the disguising mask 38 rather than analyzing the glimpses of the suppressed hidden image having portions visible between edges of the elements of text in the disguising mask. The text in the disguising mask is selected for the particular game or application. For example, the text may be a brand identifier of a company associated with the game or with a television program using the hidden message game for increasing audience viewing and involvement.

The present invention can be practiced with PHOTOSHOP ILLUSTRATOR software. For illustrative purposes and not limiting, to reduce marginal negative space between adjacent letters in the text of the disguising mask, tracking should be limited (e.g., 0) and autokerning activated. Text within rings should not have repeating characters in the adjacent ring. San-serif font with a bold weight provides satisfactory masking.

Each ring of text is created by a long string of repeating words (names, slogans, short messages, etc.) which conform across the exterior of a circular path or ring. The diameter of the largest circular path is dependent on the maximum number of characters it can support. In an illustrative embodiment, the largest or outermost circular path holds eighty characters. This outermost ring thus establishes the diameter of the disk and also determines the number of subsequent inner rings. Creating an inner ring requires duplicating the outer neighboring ring and reducing the diameter of the duplicated circular shape so that the top of the string of text touches the bottom of the text in the outer neighboring ring. The size of the text remains the same while the diameter of the circular path is adjusted. This process is repeated until the innermost ring is formed. In an illustrative embodiment, the inner ring holds seventeen characters. Further, to avoid repeating characters across adjacent rings and to achieve visual dissonance, the rings are rotated arbitrarily either clockwise or counter-clockwise.

The disk is cloned multiple times and distributed evenly across a row on a plane. Each replica subtracts from its source. More specifically, the replica's circular area with a radius from the center of the disk to the top-most point of the string of text forming the outermost ring is subtracted from the originating disk. In an illustrative embodiment, the distance between centers of adjacent disks is 75% of the disk diameter, resulting in an overall 18% subtraction from the area of the source disk.

The multiple-disk row is cloned several times over. In the illustrative embodiment, the added rows are spaced vertically at 15% distance from a center line or longitudinal axis of the adjacent row. Further, alternating rows are shifted in one direction (perpendicular to the direction of which the rows are duplicated) at 37.5% of the diameter of the disk. Each row replica subtracts from its source row. More specifically, the cloned row's cumulative area (calculated from the compilation of "welded" disks in a row—disk area is calculated as described before) is subtracted from the originating disk row. This arrangement and assemblage of disks results in the disguising shape or disguising mask 38.

With reference to FIGS. 1 and 2, the hidden image 22 is contained on the game piece 20 but the contrasting first wavelength characteristic and the second wavelength characteristic of the first and second layers 32, 34, together with the patterned mask 28, causes the hidden image to be difficult to view. The disguising mask 28 tends to dominate the visual perception of an observer with the hidden image 22 effectively in the background and of lesser observable impact to an observer. With positioning of the decoder filter 24 over the game piece 20 as shown in FIG. 3, the hidden image 22 becomes visible. This is accomplished by the decoder filter 24 blocking the transmission of light except for the light in the wavelengths of the selected ranges into which the image 52 was gradient mapped.

The present invention accordingly provides a game piece having a hidden image selectively viewable with a decoder, suitable for presentation on printed game pieces and for presentation on electronic display devices, for play of a game. While this invention has been described in detail with particular references to illustrated embodiments thereof, it should be understood that many modifications, additions and deletions, in additions to those expressly recited, may be made thereto without departure from the spirit and scope of the invention.

What is claimed is:

1. A game piece with a hidden image visible upon viewing the game piece through a decoder filter, comprising:

(a) a first visible layer comprising
an image that is gradient mapped to a first electromagnetic wavelength range,
the first electromagnetic wavelength range selected based on
a color hue for a decoder filter and
having a first starting electromagnetic wavelength and a first ending electromagnetic wavelength,
the first ending electromagnetic wavelength different than the first starting electromagnetic wavelength; and (b) a second visible layer comprising
the image that is gradient mapped to a second electromagnetic wavelength range different from the first electromagnetic wavelength range,
the second electromagnetic wavelength range selected based on the color hue for the decoder filter and
having a second starting electromagnetic wavelength and a second ending electromagnetic wavelength,
the second ending electromagnetic wavelength different than the second starting electromagnetic wavelength, and
a disguising mask having an electromagnetic wavelength within the second electromagnetic wavelength range,
whereby the image is visible upon viewing the game piece through the decoder filter.

2. The game piece as recited in claim 1, wherein
the first starting electromagnetic wavelength as viewed through the decoder filter is selectively a black color or a white color to have a first filter value and
the first ending electromagnetic wavelength viewed through the decoder filter is the non-selected one of the black color or white color to have a second filter value.

3. The game piece as recited in claim 2, wherein the first filter value and the second filter value define a gradient range for mapping the image in the first visible layer.

4. The game piece as recited in claim 2, wherein
the second starting electromagnetic wavelength viewed through the decoder filter is the non-selected one of the black color or white color and having an electromagnetic wavelength different from that of the first starting electromagnetic wavelength, to have a third filter value and
the second ending electromagnetic wavelength viewed through the decoder filter is the selected black color or white color having an electromagnetic wavelength different from that of the first ending electromagnetic wavelength, to have a fourth filter value.

5. The game piece as recited in claim 4, wherein the third filter value and the fourth filter value define a gradient range for mapping the image in the second visible layer.

6. The game piece as recited in claim 4, wherein the second starting electromagnetic wavelength is at least 15° different from the first starting electromagnetic wavelength and the second ending electromagnetic wavelength is at least 15° different from the first ending electromagnetic wavelength.

7. The game piece as recited in claim 1, wherein the decoder filter has a light transparency of between about 5% and 25%.

8. The game piece as recited in claim 1, wherein
the first electromagnetic wavelength range is selected as a range of values about a first wavelength in which the color hue of the decoder filter has a light transmission value in excess of about 1% and
the second electromagnetic wavelength range selected as a range about a second wavelength in which the color hue of the decoder filter has a light transmission of about 1% or less, the second wavelength greater than a wavelength at which the color hue of the decoder filter reaches a maximum light transmission value.

9. The game piece as recited in claim 1, wherein the second starting electromagnetic wavelength is at least 15° different from the first starting electromagnetic wavelength and the second ending electromagnetic wavelength is at least 15° different from the first ending electromagnetic wavelength.

10. A method of making a game piece with a hidden image that is visible upon viewing the game piece through a decoder filter, comprising the steps of:

(a) gradient mapping an image to a first electromagnetic wavelength range,
the first electromagnetic wavelength range selected based on
a color hue for a decoder filter and
having a first starting electromagnetic wavelength and a first ending electromagnetic wavelength,
the first ending electromagnetic wavelength different than the first starting electromagnetic wavelength
to form a first visible layer;

(b) gradient mapping the image to a second electromagnetic wavelength range different from the first electromagnetic wavelength range,
the second electromagnetic wavelength range selected based on
the color hue for the decoder filter and
having a second starting electromagnetic wavelength and a second ending electromagnetic wavelength,
the second ending electromagnetic wavelength different than the second starting electromagnetic wavelength
to form a second visible layer; and (c) attaching a disguising mask to the second visible layer, the disguising mask having an electromagnetic wavelength within the second electromagnetic wavelength range,
to form a composite two-layer game piece in which the image is visible upon viewing the game piece through the decoder filter.

11. The method as recited in claim 10, further comprising the step of selecting the first starting electromagnetic wavelength as selectively a black color or a white color of a light spectrum viewed through the decoder filter, to have a first filter value; and
the first ending electromagnetic wavelength is the non-selected one of the black color or white color, to have a second filter value.

12. The method as recited in claim 11, wherein the first filter value and the second filter value define a gradient range for step (a) mapping the image in the first visible layer.

13. The method as recited in claim 11, further comprising the step of selecting the second starting electromagnetic wavelength as the non-selected one of the black color or white color and having an electromagnetic wavelength different from that of the first starting electromagnetic wavelength, to have a third filter value and
the second ending electromagnetic wavelength viewed through the decoder filter is the selected black color or white color having an electromagnetic wavelength different from that of the first ending electromagnetic wavelength to have a fourth filter value.

14. The method as recited in claim 13, wherein the third filter value and the fourth filter value define a gradient range for mapping the image in the second visible layer.

15. The method as recited in claim 13, wherein the second starting electromagnetic wavelength is selected to be at least 15° different from the first starting electromagnetic wavelength and the second ending electromagnetic wavelength is selected to be at least 15° different from the first ending electromagnetic wavelength.

16. The method as recited in claim 10, wherein the decoder filter has a light transparency of between about 5% and 25%.

17. The method as recited in claim 10, wherein the first electromagnetic wavelength range is selected as a range of values about a first wavelength in which the color hue of the decoder filter has a light transmission value in excess of about 1% and the second electromagnetic wavelength range selected as a range about a second wavelength in which the color hue of the decoder filter has a light transmission of about 1% or less, the second wavelength greater than a wavelength at which the color hue of the decoder filter reaches a maximum light transmission value.

18. The method as recited in claim 10, wherein the second starting electromagnetic wavelength is at least 15° different from the first starting electromagnetic wavelength and the second ending electromagnetic wavelength is at least 15° different from the first ending electromagnetic wavelength.

* * * * *